United States Patent [19]

Estes et al.

[11] Patent Number: 4,610,366

[45] Date of Patent: Sep. 9, 1986

[54] ROUND JUICE BOTTLE FORMED FROM A FLEXIBLE MATERIAL

[75] Inventors: Ann E. Estes, Toledo; Donald J. Staczek, Perrysburg, both of Ohio

[73] Assignee: Owens-Illinois, Inc., Toledo, Ohio

[21] Appl. No.: 801,275

[22] Filed: Nov. 25, 1985

[51] Int. Cl.[4] ..... B65D 23/00

[52] U.S. Cl. ..... 215/1 C; 215/31; 206/524.2; 220/72

[58] Field of Search ..... 215/2, 1 C, 1 R, 31; 206/524.2; 220/72

[56] References Cited

U.S. PATENT DOCUMENTS

| | | | |
|---|---|---|---|
| D. 171,647 | 3/1954 | Hills | 215/1 R |
| 2,780,378 | 2/1957 | Romano | 215/1 C |
| 3,083,877 | 4/1963 | Gash | 215/1 C |
| 3,091,360 | 5/1963 | Edwards | 215/1 C |
| 3,163,544 | 12/1964 | Valyi | 215/1 C |
| 3,185,353 | 5/1965 | Mercier | 215/1 C |
| 3,340,869 | 9/1967 | Bane | 215/1 C |
| 3,474,844 | 10/1969 | Lindstrom et al. | 215/1 C |
| 3,954,200 | 5/1976 | Willis | 215/1 C |

*Primary Examiner*—Joseph Man-Fu Moy
*Attorney, Agent, or Firm*—Philip M. Rice

[57] ABSTRACT

A distortion-resistant, round, multi-layer plastic bottle for the packaging of at least 48 fl. oz. of an oxygen-sensitive, hot-fill product such as tomato juice or a citrus juice, the material used in the construction of the bottle including a layer of an oxygen barrier material, the bottle having a generally cylindrical main body portion, such main body portion having a vertical series of horizontal corrugations, such corrugations being capable of partially collapsing in the vertical direction to accommodate the contraction of the product due to cooling after filling and capping, to thereby keep the round main body portion of the bottle, which receives a cylindrical or part cylindrical double-ended or cylindrical endless label, from distorting inwardly in an hourglass shape due to the cooling of the product.

30 Claims, 4 Drawing Figures

ROUND JUICE BOTTLE FORMED FROM A FLEXIBLE MATERIAL

BACKGROUND OF THE INVENTION

1. Field of the Invention

The present invention relates to a round, multi-layer flexible plastic bottle that is suitable for the packaging of an oxygen-sensitive, hot-fill product such as a comestible juice product, and the present invention further relates to a package that includes such a bottle with the packaged product contained therein and with a closure and label applied thereto.

2. Description of the Prior Art

Over the course of the past several years, blown plastic bottles have replaced glass bottles and metal cans as the preferred package for packaging many products, including many liquid products. This trend has developed and continued due to the many costs and handling advantages which plastic bottles have relative to glass bottles and metal cans. Until recently however, one of the characteristics of blown plastic bottles that has limited its suitability for many packaging applications was the fact that the available plastic materials were susceptible to oxygen migration through the plastic material. Many food products tend to degrade when exposed to oxygen over prolonged periods of time and, thus, until recently, such food products could not be packaged satisfactorily in blown plastic bottles.

In more recent times, technology has developed which permits the production of blown plastic bottles from a co-extruded material that includes a multiplicity of layers of various of organic materials, and in this so-called multi-layer plastic packaging technology, it is possible to include a layer of an organic material that serves as an effective barrier to the transmission of oxygen, such as ethylene vinyl alcohol, or polyvinyledene chloride. Such barrier materials tend to be quite expensive, but through the multi-layer technology, the use of such a barrier material is economically feasible for many packaging applications because the barrier layer can be quite thin, other layers of the multi-layer bottle construction of a less expensive nature being utilized to impart virtually all of the needed structural strength of the finished product. Thus, multi-layer plastic bottles that include an oxygen barrier layer are now in use in the packaging of oxygen-sensitive food products, such as catsup and barbecue sauces.

Another of the characteristics of a plastic bottle relative to a glass bottle or a metal can is the flexibility or the lack of rigidity of the plastic bottle, and this characteristic is shared by blown plastic multi-layer bottles. This characteristic is especially pronounced in the packaging of products that tend to change in volume after the filling and closing of the bottle, such as hot-fill food products that tend to shrink in volume due to thermal contraction after the capping of the filled bottle while the contents are still hot. Other products tend to change in volume due to the volatile or gas absorbing nature of the packaged product, as is explained in U.S. Pat. No. 4,387,816 (R. L. Weckman), which is assigned to the assignee of this application.

The tendency for certain packaged products to change in volume after packaging and capping, as described above, tends to change the shape of a plastic bottle because of the inherent flexibility of known types of plastic bottles, including multi-layer plastic bottles, and this is a problem which is new to the use of plastic bottles for these packaging applications, glass bottles and metal cans having sufficient inherent rigidity to resist the forces resulting from such a change in the volume of the package without a material degree of distortion of the shape of the glass bottle or metal can, as the case may be.

Many plastic bottle designs have been proposed in an effort to deal with the problem of the distortion of the shape of a plastic bottle due to a change in the volume of the packaged product, but such designs tend to involve the use of oval or flat-panel or other non-round bottles, such as that described in the aforesaid U.S. Pat. No. 4,387,816. Thus, for example, multi-layer plastic bottles for the packaging of catsup are generally oval in shape, notwithstanding that prior art glass catsup bottles were round or polygonol in shape. Insofar as the packaging of catsup is concerned, the use of a non-round or non-polygonal bottle has proved to be advantageous, because an oval bottle can be more readily squeezed than a round or square bottle, and such squeezability assists in the withdrawal of the catsup due to its viscous nature.

Certain hot-fill comestible liquid products, however, such as tomato juice and citrus juices, can be readily withdrawn from a multi-layer plastic bottle without squeezing, and the use of a non-round bottle for the packaging of any such product, therefore, offers no particular functional advantage. In fact, such products have traditionally been packaged in glass bottles of a round shape, and the round bottle shape is now associated with such juice products and offers certain marketing advantages in connection with the packaging of such juice products. In addition, round bottles can be more readily processed on existing filling lines that were installed for the filling of cans or glass bottles, as round bottles need not be oriented in the circumferential direction in any particular manner as they travel through any such filling line, thus reducing the capital costs involved in adapting any such existing filling line to the handling of plastic bottles. However, it has not been heretofore possible to package such hot-fill juice products in round, multi-layer plastic bottles because of the distortion in shape experienced by the bottle as the volume of the juice contracts as a result of the cooling of the juice from the fill temperature, typically at least approximately 190° F., after the capping of the bottle, a step which normally occurs immediately after filling. This distortion is particularly severe in the case of a bottle that utilizes a generally cylindrical main body portion, since it tends to occur at the middle of the cylindrical main body portion, producing an hourglass configuration. This a problem which complicates the application of a double-ended or wraparound label to the bottle, since such a label is normally applied to the cylindrical main body portion of a round bottle, and the effect is particularly pronounced in the large bottles, e.g., typically 48 fl. oz. and 64 fl. oz (or 1.5 liters and 2.0 liters) that are popular in the packaging of hot-fill juice products.

SUMMARY OF THE INVENTION

In accordance with the present invention there is provided a distortion-resistant, round, multi-layer plastic bottle for the packaging of at least 48 fl. oz. of an oxygen-sensitive, hot-fill liquid product and, in particular, a juice product such as tomato juice or orange juice or other citrus juice. The bottle according to the present invention may be produced by blow molding a co-extruded, multi-layer parison, the layers of such multi-layer parison including one or more layers of a structural polymeric material that has good strength at the temperatures used in the filling of hot-fill liquids, such as a propylene-based material, and a layer of an oxygen-barrier material such as ethylene vinyl alcohol or polyvinyledene chloride, preferably with the oxygen-barrier layer sandwiched between the structural propylene-based layers, and preferably also including a layer of a reprocessed scrap material, that may include reground scrap multi-layer bottles, and also including one or more layers of a special adhesive of a type which is used to bond dissimilar organic materials, where needed. The bottle according to the present invention has a generally cylindrical main body portion, and an open top through which the bottle is adapted to be filled and emptied. The open top has a threaded finish for receiving a screw-on plastic or metal closure to permit the bottle to be closed and sealed after filling, and there is a generally hour-glass-shaped grip portion disposed between the finish portion of the container and the generally cylindrical main body portion.

The main body portion has a vertical series of horizontally extending corrugations, each corrugation being circumferentially endless, and each corrugation having a relatively flat tip portion that lies along a generally cylindrical discontinued outer surface of the bottle, a generally flat root portion which lies radially inwardly from the generally flat tip portion, and a connecting portion extending between the generally flat root portion and the generally flat tip portion. Because the root portion and the tip portion of each corrugation is generally flat, there will be a relatively sharp corner formed at the juncture of the tip portion and the connecting portion and at the juncture of the connecting portion and the root portion. When such a bottle is filled with a hot-fill liquid product, such as tomato juice or a citrus juice, products which are normally filled at a fill temperature of at least approximately 190° F., and such bottle is sealingly capped shortly after filling, the horizontal corrugations in the generally cylindrical main body portion of the bottle will partially collapse upon cooling primarily by bending at the relatively sharp corners formed at the junctures between the tip portion and the connecting portion, and the connecting portion and the root portion, respectively, of each such corrugation. This will allow the overall vertical height of the bottle to shrink to accommodate the shrinkage of the liquid within the bottle, as a result of contraction due to the natural cooling of the product which will occur after the bottle has been filled and capped, and this vertical shrinkage of the bottle will substantially prevent the generally cylindrical main body portion of the bottle from shrinking radially inwardly, particularly at the center portion thereof, an effect which would otherwise tend to impart an hourglass configuration to the generally cylindrical main portion of the body. By, thus, maintaining the main body portion of the bottle in a generally cylindrical configuration, after the hot filling and capping of the bottle, the bottle may be readily labeled with a double-ended or endless paper or plastic label, in a known manner, without leading to any wrinkling or other distortion of such label.

Another feature of the bottle of the present invention is that, to accommodate conventional filling and processing equipment, such bottle is preferably formed with a constricted portion, disposed beneath the finish portion and above the hand grip portion, such constricted portion having a lesser radial extent than either of the constricted portion or the enlarged portion therebelow, such constricted portion thereby being useful in the pouring of liquid from the bottle, because it is adapted to receive the rim of a drinking glass or other container into which the liquid from the bottle is to be poured.

While collapsible round plastic bottles are not generally new, see, for example, U.S. Pat. No. 4,492,313 to Touzani, the collapsible feature of such prior patent is utilized after the bottle has been opened, and a portion of its contents withdrawn, and such collapsibility is not taught as a feature for accommodating the contraction of a hot-fill product after the bottle has been filled and capped while such product is still at an elevated temperature.

Accordingly, it is an object of the present invention to provide a round, multi-layer, flexible plastic bottle that is suitable for the packaging of an oxygen-sensitive, hot-fill liquid product.

It is a further object of the present invention to provide a package that includes a round, multi-layer flexible plastic bottle that contains an oxygen-sensitive liquid product that was placed in such a bottle while such product was at an elevated temperature, together with a closure that sealingly closes such bottle and was applied thereto while such liquid product was at an elevated temperature.

It is also an object of the present invention to provide a package as described above in which such bottle has a generally cylindrical main body portion that is suitable for receiving a thin paper or plastic label, and it is a corollary object of the present invention to provide such a package to which such a label has been applied.

For further understanding of the present invention and the objects thereof, attention is directed to the drawing and the following description thereof, to the detailed description of the invention, and to the appended claims.

DETAILED DESCRIPTION OF THE INVENTION

Figure 1:
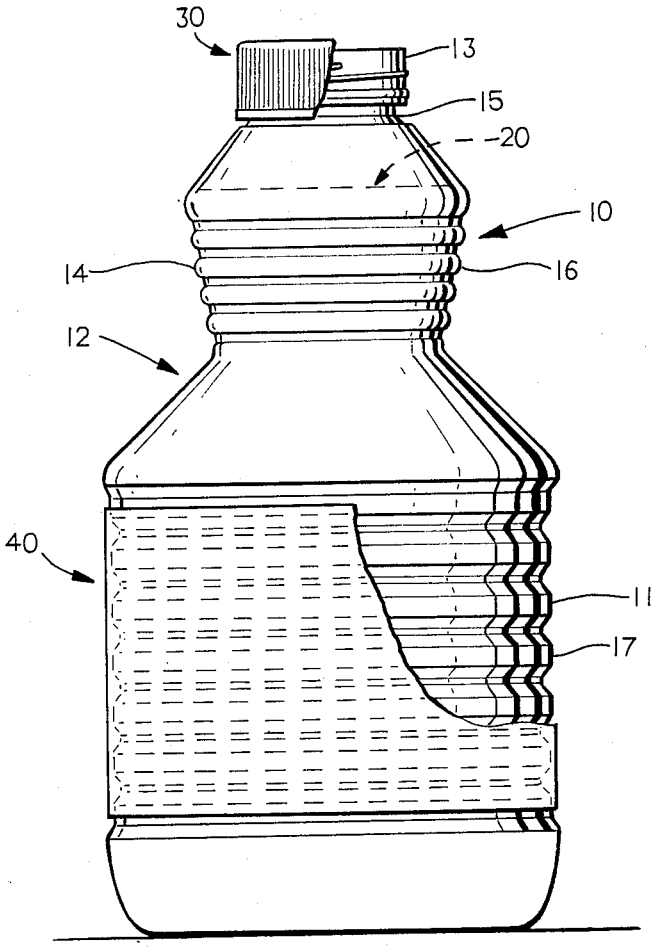
FIG. 1 is a elevational view of a package according to the present invention, such a package including a bottle, a closure, shown fragmentarily, applied to such bottle, and a label, also shown fragmentarily, also applied to such bottle.
Figure 2:
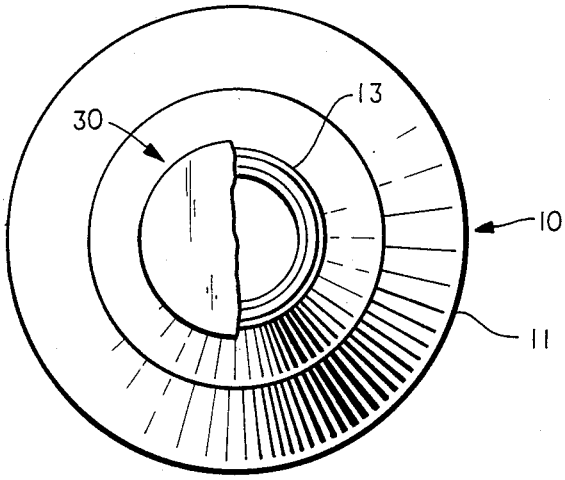
FIG. 2 is a top plan view of the package shown in FIG. 1.

A package according to the present invention includes a round bottle, identified generally be reference numeral 10, a liquid packaged in such bottle, identified generally by reference numeral 20, a closure applied to and sealingly closing the bottle 10, such closure being shown fragmentarily in FIGS. 1 and 2 and being identified generally by reference numeral 30, and a label that is applied to a generally cylindrical main body portion 11 of the bottle 10, such label being identified generally by reference numeral 40. The bottle 10 also includes an open top portion, identified generally by reference numeral 12, and the bottle 10 may be filled with the product 20 through the open top portion 12 of the bottle, and the product 20 may be emptied from the bottle 10 through the open top portion 12 upon the removal of the closure 30 from the bottle 10. The open top portion 12 of the bottle 10 includes an externally threaded finish portion 13, to which the closure 30, which may be considered to be an internally threaded metal or plastic closure of a known type, may be applied in a known fashion, and the open top portion 12 of the bottle 10 also includes a generally hourglass-shaped hand grip portion 14, which hand grip portion 14 is separated from the finish portion 13 by means of a constricted portion 15 which is necessary to permit the bottle to be filled and capped on conventional filling and capping equipment. The constricted portion 15 is also useful in pouring some of the product 20 from the bottle 10, as it fits nicely over the rim of a tumbler or other container into which the product 20 is to be poured, and thereby helps to eliminate spillage of the product 20 during the emptying of the bottle 10. The hand grip portion 14 of the bottle 10 is preferably provided with a vertical series of horizontal ribs 16 to provide strength and rigidity in the gripping area of the bottle, and also to provide a non-smooth surface to assist in the gripping of the bottle without slippage, a feature which is particularly useful if the outside surface of the bottle 10 is moist, for example, due to the spillage of the liquid contents thereon, or to the formation of condensate thereon if the bottle 10 has been chilled and is thereafter left in a warm, moist environment.

The main body portion 11 of the bottle 10 is provided with a vertical series of horizontally extending endless corrugations 17, each of which is provided with a generally flat tip portion 17*a*, a generally flat root portion 17*b* and a connecting portion 17*c* that connects each tip portion 17*a* with a corresponding root portion 17*b*. Because the tip portion 17*a* and root portion 17*b* are generally flat, there will be a relatively sharp corner 17*d* formed at the juncture of each tip portion 17*a* and a corresponding connecting portion 17*c*, and a generally sharp corner 17*e* formed at the juncture of each root portion 17*b* and the corresponding connecting portion 17*c*. By virtue of the inclusion of the corrugations 17 in the main body portion 11 of the bottle 10, the bottle 10 is capable of partially collapsing in a vertical direction upon the cooling of the product 20 after the placement of the closure 30 on the bottle 10 while the product 20 is still at an elevated temperature, which will normally be approximately at the filling temperature 190° F. The partial collapsing of the corrugation 17 of the main body portion 11 of the bottle 10 is assisted by the presence of the relatively sharp corners 17*b* and 17*e* in the corrugations 17, each such corner in effect acting as a hinge.

By virtue of the partial collapsing of the corrugations 17 of the main body portion 11 of the bottle 10, upon the cooling and the contraction of the product 20 in the bottle 10 after the affixing of the closure 30 to the bottle 10, as heretofore described, the tip portions 17*a* of the corrugation 17, which originally, preferably, were located so as to define a discontinued, generally cylindrical outer surface of the main body portion 11 of the bottle 10, will remain in such generally cylindrical configuration, without any pinching in, or other distortion of the main body portion 11 of the bottle 10 and, therefore, the label 40, which will normally define a cylindrical or a part cylindrical configuration when it is applied to the main body portion 11 of the bottle 10, may be applied without any distortion or wrinkling of such label 40.

Figure 3:
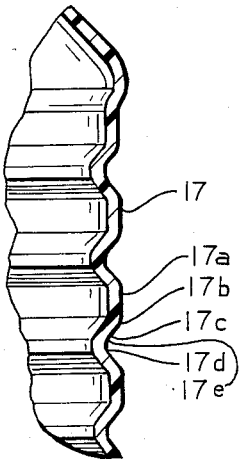
FIG. 3 is a fragmentary sectional view, at an enlarged scale, showing a portion of the wall of the bottle illustrated in FIGS. 1 and 2.
Figure 4:
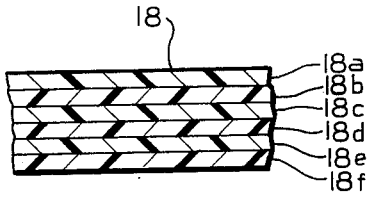
FIG. 4 is a fragmentary view showing the various layers that make up the construction of the bottle shown in FIGS. 1 through 3.

As is shown in FIG. 4, the wall of the bottle 10 is preferably of a multi-layer construction, such wall being identified by reference numeral 18 and being made up of individual layers 18*a*, 18*b*, 18*c*, 18*d*, 18*e*, and 18*f*. The innermost and outermost of the layers of the wall 18, namely layers 18*a* and 18*f*, are the main structural layers which impart strength and rigidity to the bottle, and are preferably formed of a propylene-based polymeric material, because such polymeric materials retain good strength and rigidity characteristics at temperatures of the order of 190° F., the temperatures at which hot-fill liquid products, such as tomato juice and citrus juices are packaged. Polypropylene and ethylene-propylene copolymer are the preferred propylene-based polymeric materials used in the production of bottles that are to be hot-filled with a liquid juice product.

Another of the layers of the wall 18, preferably layer 18*d*, is a relatively thin layer of an organic, oxygen-impermeable barrier material such as ethylene vinyl alcohol or polyvinyledene chloride, to protect the product 20 from the deleterious affects of oxygen in the atmosphere surrounding the bottle 10. Typically, such a barrier material does not bond readily to a propylene-based material, and in such case an adhesive layers 18*c* and 18*e* may be included in the wall 18 to help bond such dissimilar materials. Because there is a certain amount of scrap that is generated in mass production of bottles, such as the bottle 10, and because it is economically advantageous to reclaim such scrap, the wall 18 also may advantageously include a layer 18*b*, sandwiched between the innermost and outermost layers 18*a* and 18*f*, respectively, such a layer 18*b* including such reprocessed scrap to help provide some of the needed strength and rigidity of the bottle 10 and to thereby reduce the amount of the propylene-based material that need be used in the layers 18*a* and 18*f*. The bottle 10 is produced with a multi-layer wall 18, as described, by initially co-extruding a preform or parison of such a multi-layer construction from the various polymer melts that make up such multi-layer wall 18 within a single diehead, in a known manner, and by reforming such preform or parison by blow-molding, as is also well known.

The bottle 10, as heretofore described, is especially useful in the packaging of relatively large volumes of liquid juice products, such as the 48 fl. oz. and 64 fl. oz. size bottles which are popular in the packaging of various juice products, or in the 1.5 liter and 2.0 liter metric versions of such bottles. Such bottles retain the generally round shape of corresponding prior art glass bottles which have proven to be popular in the packaging of juice products, without requiring the use of oval, flat-panel or other non-round bottles when such hot-fill juice products are packaged in multi-layer plastic bottles. Also, because the bottle 10 preserves the round-shape of prior art glass bottles for hot-fill juice products, it has maximum potential for lightweighting, which helps to minimize packaging costs, it has a shape which processes smoothly on conventional filling lines, at good filling line speeds, and it can be readily labeled by standard labeling equipment.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A bottle that is adapted to be filled with a liquid product that is at an elevated temperature, said bottle being formed from a flexible material that includes at least a structural layer of a polymeric material with a softening temperature that permits said structural layer to retain sufficient strength to keep said bottle from collapsing when said structural layer becomes heated as a result of the filling of said bottle with said liquid product when said product is at said elevated temperature, said bottle comprising, in combination:

an open top through which said bottle is adapted to be filled with said liquid product added to a closed bottom; and a body portion having a central axis, said central axis extending generally vertically when said bottle is in an upright position, said bottom of said bottle being adapted to be supported on a horizontal surface when said bottle, is in said upright position, said body portion being generally circular in a plane extended transversely of said central axis of said bottle said body portion having corrugation means extending around said body portion, said corrugation means being adapted to at least partially collapse in a direction extending parallel to said central axis of said bottle after the filling of said bottle with said liquid product at said elevated temperature and the capping of said bottle while said product is still at an elevated temperature to accommodate the cooling of said liquid product after the filling and capping of said bottle, and to thereby substantially prevent deflection of said body portion of said bottle in a plane extending transversely of said central axis of said bottle due to the cooling of said liquid product.

2. A bottle according to claim 1 wherein said flexible material comprises first and second spaced-apart structural layers of said polymeric material, and additional layer means disposed between said first and second spaced-apart structural layers.

3. A bottle according to claim 2 wherein one of said first and second spaced-apart structural layers of said polymeric material comprises an innermost layer that is adapted to be contacted by said liquid product when said bottle is filled with said liquid product, and wherein the other of said first and second spaced-apart structural layers of said polymeric material comprises an outermost layer.

4. A bottle according to claim 1 wherein said bottle is adapted to be filled and capped when said liquid product is at a temperature of at least approximately 190° F., and wherein said polymeric material is a propylene-based material.

5. A bottle according to claim 4 wherein said propylene-based material comprises a material that is selected from the group consisting of polypropylene and ethylene-propylene copolymer.

6. A bottle according to claim 1 wherein said corrugation means comprises a plurality of corrugations, said corrugations in said plurality of corrugations extending generally parallel to one another and being disposed in a series that extends generally transversely of the corrugations in said plurality of corrugations.

7. A bottle according to claim 6 wherein each of said corrugations has an outermost tip portion, an innermost root portion and a connecting portion that connects said tip portion and said root portion, said tip portion being generally flat, said root portion being generally flat, said connecting portion forming a first sharp corner with said tip portion and a second sharp corner with said root portion, said first sharp corner and said second sharp corner facilitating the at least partial collapse of said corrugation means to accommodate said cooling of said liquid product.

8. A bottle according to claim 7 wherein said generally flat tip portions of each of said corrugations are generally aligned to define a discontinued generally cylindrical surface to facilitate the application of an at least partially cylindrical label to said body portion of said bottle.

9. A bottle according to claim 1 wherein said bottle is adapted to contain an oxygen-sensitive liquid product, said flexible material further comprising a layer that serves as a barrier to the transmission of oxygen.

10. A bottle according to claim 9 wherein said layer that serves as a barrier to the transmission of oxygen is formed from an organic material.

11. A bottle according to claim 10 wherein said organic material is selected from the group consisting of ethylene vinyl alcohol and polyvinyledene chloride.

12. A bottle according to claim 9 wherein said flexible material is produced by a process that includes a step of co-extruding said structural layer and said layer that serves as a barrier to the transmission of oxygen.

13. A bottle according to claim 12 wherein said bottle is adapted to contain at least approximately 48 fl. oz. of said liquid product.

14. A bottle according to claim 1 wherein said open top comprises:

a finish that is adapted to receive a closure;

a constricted portion disposed beneath said finish; and an enlarged portion disposed below said constricted portion and extending from said constricted portion to said body portion, said constricted portion being adapted to receive the rim of a container into which said liquid product is to be poured, whereby said liquid product can be poured into said container with little spillage of said liquid product.

15. A package comprising, in combination:

a bottle, said bottle being formed from a flexible material that includes a structural layer of a polymeric material with a softening temperature that permits said structural layer to retain sufficient strength to keep said bottle from collapsing when said structural layer becomes heated as a result of the filling of said bottle with a liquid product at an elevated temperature, said bottle comprising:

an open top through which said bottle is adapted to be filled with said liquid product, said open top being adapted to be closed by a closure to close and seal said bottle;

a closed bottom; and a body portion having a central axis extending generally vertically when said bottle is in an upright position, said bottom of said bottle being adapted to be supported on a horizontal surface when said bottle is in said upright position, said body portion being generally circular in a plane extending transversely of said central axis of said bottle, said body portion having corrugation means extending around said body portion;

a liquid product contained in said bottle, said liquid product having been filled into said bottle while said liquid product is at an elevated temperature; and a closure affixed to said open top of said bottle, said closure closing and sealing said bottle after being affixed to said bottle, said closure being affixed to said open top of said bottle while said liquid product is at an elevated temperature, said liquid product being adapted to cool to a temperature lower than said elevated temperature at which said closure is affixed to said open top of said bottle, the cooling of said liquid product at least partially collapsing said corrugation means in a direction extending parallel to said central axis to accommodate the cooling of said liquid product to thereby substantially prevent deflection of said body portion of said bottle in a plane extending transversely of said central axis of said bottle due to the cooling of said liquid product.

16. A package according to claim 15 wherein said body portion of said bottle defines a generally cylindrical surface, said generally cylindrical surface being discontinued at the location of said corrugation means, and further comprising:

a sheetlike at least partially cylindrical label at least partially surrounding and being affixed to said body portion of said bottle, said sheetlike label at least partially covering said corrugation means of said bottle.

17. A package according to claim 16 wherein said sheetlike label is affixed to said body portion of said bottle after said cooling of said liquid product and the at least partial collapsing of said corrugation means.

18. A package according to claim 15 wherein said closure is affixed to said bottle while said liquid product is at a temperature of at least approximately 190° F.

19. A package according to claim 18 wherein said liquid product is a comestible juice product.

20. A package according to claim 15 wherein said flexible material comprises first and second spaced-apart structural layers of said polymeric material, and additional layer means disposed between said first and second spaced-apart structural layers.

21. A package according to claim 19 wherein said flexible material comprises first and second spaced-apart structural layers of said polymeric material, and additional layer means disposed between said first and second spaced-apart structural layers.

22. A package according to claim 21 wherein each of said first and second spaced-apart structural layers is a propylene-based material.

23. A package according to claim 22 wherein said propylene-based material comprises a material that is selected from the group consisting of polypropylene and ethylene-propylene copolymer.

24. A package according to claim 23 wherein said additional layer means comprises a layer that serves as a barrier to the transmission of oxygen.

25. A package according to claim 24 wherein said layer that serves as a barrier to the transmission of oxygen is formed from an organic material.

26. A package according to claim 25 wherein said organic material is selected from the group consisting of ethylene vinyl alcohol and polyvinyledene chloride.

27. A package according to claim 25 wherein said flexible material is produced by the co-extrusion of said first and second spaced-apart structural layers and said layer that serves as a barrier to the transmission of oxygen.

28. A package according to claim 15 wherein said corrugation means comprises a plurality of corrugations, said corrugations in said plurality of corrugations extending generally parallel to one another and being disposed in a series that extends generally transversely of the corrugations in said plurality of corrugations.

29. A package according to claim 28 wherein each of said corrugations has an outermost tip portion, an innermost root portion and a connecting portion that connects said tip portion and said root portion, said tip portion being generally flat, said root portion being generally flat, said connecting portion forming a first sharp corner with said tip portion and a second sharp corner with said root portion, said first sharp corner and said second sharp corner facilitating said at least partial collapse of said corrugation means to accommodate said cooling of said liquid product.

30. A package according to claim 29 wherein said package contains at least approximately 48 fl. oz. of said liquid product.

* * * * *